US006725819B2

(12) United States Patent
Yates

(10) Patent No.: US 6,725,819 B2
(45) **Date of Patent: *Apr. 27, 2004**

(54) ROCKER LEVER BALL SOCKET RETAINER

(75) Inventor: Calvin Yates, Columbus, IN (US)

(73) Assignee: Cummins Engine Company, Inc., Columbus, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/269,783

(22) Filed: Oct. 14, 2002

(65) Prior Publication Data

US 2003/0037744 A1 Feb. 27, 2003

Related U.S. Application Data

(63) Continuation of application No. 09/716,654, filed on Nov. 20, 2000, now Pat. No. 6,463,898.

(51) Int. Cl.[7] ..... F01L 1/38

(52) U.S. Cl. ..... 123/90.39; 123/90.44; 123/90.52

(58) Field of Search ..... 123/90.34, 90.35, 123/90.39, 90.4, 90.41, 90.42, 90.43, 90.44, 90.45, 90.46, 90.47; 74/519, 559; 29/888.2

(56) References Cited

U.S. PATENT DOCUMENTS

| | | | | |
|---|---|---|---|---|
| 1,521,623 A | | 1/1925 | Hendrickson | 123/90.39 |
| 3,314,404 A | | 4/1967 | Thompson | 123/90.43 |
| 3,563,214 A | | 2/1971 | Medenus | 123/90.27 |
| 4,192,263 A | | 3/1980 | Kitagawa et al. | 123/90.39 |
| 4,815,424 A | | 3/1989 | Buuck et al. | 123/90.46 |
| 5,425,347 A | | 6/1995 | Zinke, II | 123/568 |
| 5,515,821 A | * | 5/1996 | Wolck, Jr. | 123/90.37 |
| 5,577,469 A | | 11/1996 | Muller et al. | 123/90.16 |
| 5,617,818 A | | 4/1997 | Lüders | 123/90.27 |
| 5,706,771 A | * | 1/1998 | Van Heyningen et al. | 123/90.46 |
| 5,775,280 A | | 7/1998 | Schmidt et al. | 123/90.41 |
| 6,138,624 A | * | 10/2000 | Wolck et al. | 123/90.39 |
| 6,199,526 B1 | | 3/2001 | Knickerbocker | 123/90.39 |
| 6,273,042 B1 | | 8/2001 | Perez et al. | 123/90.39 |
| 6,463,898 B1 | * | 10/2002 | Yates | 123/90.39 |

* cited by examiner

*Primary Examiner*—Thomas Denion
*Assistant Examiner*—Ching Chang
(74) *Attorney, Agent, or Firm*—Woodard, Emhardt, Moriarty and McNett & Henry LLP

(57) ABSTRACT

The present invention provides a mechanism of retaining a rocker lever ball socket on a rocker lever ball. The mechanism provided is a retaining cap which is adapted to fit over and securely engage to the socket through a tab and groove arrangement and is made of a slightly elastic material and includes a restricted opening sized smaller than the fullest diameter of the rocker lever ball. During assembly, the retaining cap first interlocks with the socket by a tab and groove arrangement, and the lever ball is then pushed through the restricted opening. The restricted opening, being slightly elastic, enlarges to allow passage of the ball and retracts to a size smaller than the ball so that it is retained thereon.

2 Claims, 4 Drawing Sheets

ROCKER LEVER BALL SOCKET RETAINER

REFERENCE TO RELATED APPLICATION

The present application is a continuation application of U.S. patent application Ser. No. 09/716,654, filed Nov. 20, 2000 now U.S. Pat. No. 6,463,898 entitled "Rocker Lever Ball Socket Retainer", now pending, which is hereby incorporated by reference in its entirety.

FIELD OF THE INVENTION

The present invention relates to a rocker valve for internal combustion engines. More specifically, the invention relates to a retaining mechanism for coupling the rocker arm of the rocker valve to its support element.

BACKGROUND OF THE INVENTION

Ball and socket rocker valves are common in valve drive devices which require systematic opening and closing of the valve. The rocker valves generally employ a rocker lever, which is movably pivoted by a cam, to drive a valve ball within its support element. Typically, the support element is a complementary spherical socket. The retention of the socket to its valve ball is a common concern for the design of these types of rocker valves. The use of a securing device to retain the socket to its valve ball is a general solution.

Metal clips, stampings, and wire forms are common forms of securing devices. These devices engage a part of the support element on the one hand and the valve ball on the other hand to establish a positive connection between the support element and the valve ball. For instance, U.S. Pat. No. 1,521,623 to Hendrickson teaches a valve mechanism using a securing device constructed of a strip of sheet metal to maintain the seated position of a valve ball within a ball seat. Hendrickson's valve mechanism includes a rocker lever having a shaped cavity for engaging the valve ball, a push rod having a ball seat defined at one end, and the valve ball resting loosely on the ball seat and under the shaped cavity. The lower end of the strip of sheet metal is clamped to the push rod, the upper end of which is bent over the rocker arm, preventing it from getting too far away from the ball. However, because there is a potential that the loose valve ball may fall out of its seat, this design is not suitable for installation on valve mechanisms that may be subjected to tilting.

An example of a securing device of a rocker valve assembly which incorporates a metal wire clip to hold a valve ball (not shown) and its support socket together is shown in FIGS. 1–3. As shown in FIG. 1, this prior art design employs an interior groove concept where the support socket 20 is provided with a wire clip groove 21 on the interior surface of support socket 20 for receiving a wire clip 22. Support socket 20 further includes a valve ball cavity 23 configured to receive and support the valve ball. As shown in FIGS. 2 and 3, wire clip 22 is in the form of an irregular ring having the two open ends 24 and 25 overlapping each other and enclosing an aperture 26. In its natural, unloaded state, wire clip 22 has an outside dimension that is configured to be retained within wire clip groove 21 and aperture 26 has, at its widest dimension, a width A which is smaller than the largest diameter (fullest circumference) of the valve ball. During assembling of the securing device, wire clip 22 is installed first into wire clip groove 21 and then the valve ball is inserted through aperture 26 into valve ball cavity 23. When the valve ball is pushed against aperture 26, open ends 24 and 25 slide apart enlarging aperture 26 and allowing passage of the valve ball beyond its fullest circumference; when the pressure is relaxed, open ends 24 and 25 spring back restoring the natural, unloaded dimension of aperture 26 and capturing the valve ball in ball cavity 23. Installation of wire clip 22 into wire clip groove 21 of support socket 22 may be done with automated equipment. However, because interior wire clip groove 22 is located inside support socket 20 and is hidden from view, especially when installation is performed with automated equipment, it is not easy to determine whether wire clip 22 is correctly and fully inserted in wire clip groove 21. Improper installation of wire clip 22 has contributed to many cases of missing support socket 20 from the rocker valve assembly. In addition, this interior groove design is costly to machine and requires complicated equipment to assemble the components.

A different style of securing device has been disclosed in U.S. Pat. No. 5,775,280 to Schmidt, et. al. Schmidt teaches a valve control mechanism including a support member with a spherical end which is received in a concave recess (socket) of a finger lever. The finger lever is secured onto the support member by a plastic retention cap. The retention cap appears to be retained by interference fit around the periphery of the concave recess. However, it is known that interference fit is prone to unexpected separation, so this securing device is not suitable for many applications where the valve mechanisms may be subjected to pulling forces.

It may be appreciated, therefore, that there is a need for a new and improved securing device which can reliably and securely hold the valve ball and socket of a rocker valve together, the assembly of which is simple and conducive to automated assembly methods.

SUMMARY OF THE INVENTION

The present invention discloses a securing device having mechanical interlocking features for the retention of a rocker lever ball socket on a rocker lever ball of a rocker valve assembly. In particular, the rocker valve assembly includes a rocker lever with a valve ball attached thereto that engages a socket having a spherical pocket which receives the valve ball. The socket is provided with a groove on its outer diameter and the retaining cap is provided with inward protruding tabs on its inner diameter. In an assembled configuration, the tabs interlock within the groove thereby retaining the retaining cap in the socket. The retaining cap includes a circular aperture at one end, allowing the stem of the valve ball to extend out of the socket and be attached to the rocker lever. The dimension of the aperture is sized to be smaller than the full circumference of the valve ball. In one specific embodiment, the retaining cap is constructed of a slightly elastic material so that, during installation, the aperture can be elastically deformed to allow passage of the valve ball and then retracts to its natural, unloaded dimension so that the valve ball is captured within the socket.

One object of the present invention is to provide an improved securing device for retaining a support socket onto a valve ball of a rocker valve assembly.

This and other objects of the present invention will be apparent from the following description of the preferred embodiments.

DESCRIPTION OF THE PREFERRED EMBODIMENTS

Figure 1:
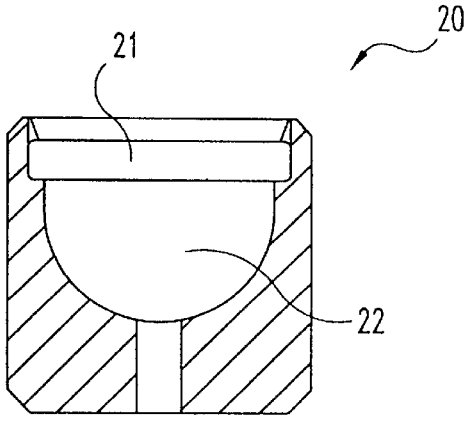
Fig. 1 (PRIOR ART)
FIG. 1 is a side elevational view, in full section, of a prior art rocker lever ball socket having an interior groove for accepting a securing device.
Figure 2:
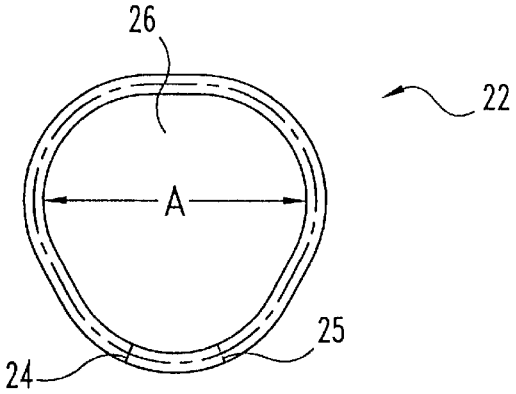
Fig. 2 (PRIOR ART)
FIG. 2 is a top plan view of a wire clip, an example of a prior art securing device for coupling a valve ball to its socket.
Figure 3:
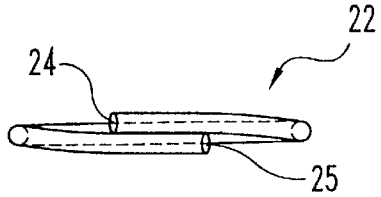
Fig. 3 (PRIOR ART)
FIG. 3 is a side elevational view of the wire clip of FIG. 2.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates are included.

Figure 4:
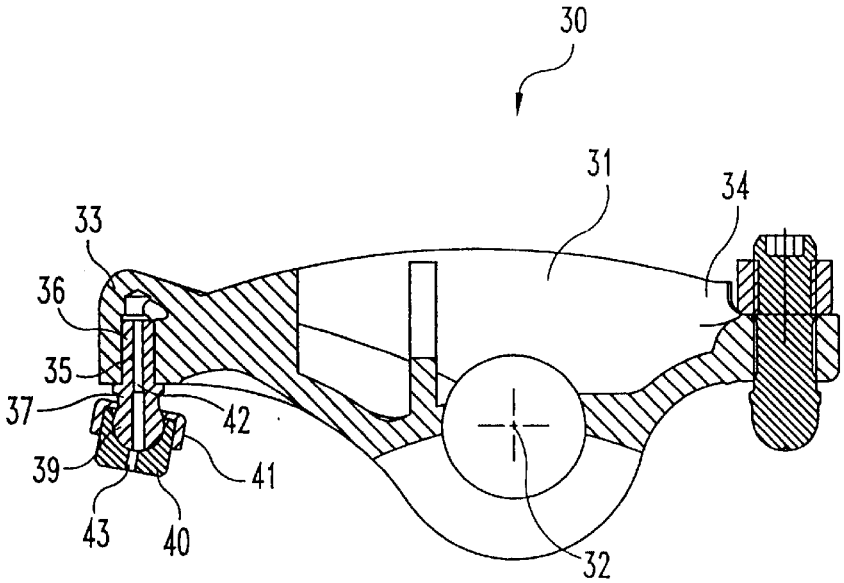
FIG. 4 is a front elevational view, in full section, of a rocker valve assembly including an embodiment of an assembled ball and socket assembly of the present invention.

Referring now to the drawing in which like reference numerals designate corresponding components throughout the several views, there is shown generally in FIG. 4 an embodiment of a rocker valve assembly 30 of the present invention. The rocker valve assembly 30 includes a rocker lever 31 pivotally mounted on a rocker lever shaft 32 and having a first arm 33 and a second arm 34. First arm 33 includes a cylindrical recess bore 35 which is in fluid communication with the engine (not shown). Cylindrical recess bore 35 is also adapted to receive a post member 36 of a rocker lever ball 37. Post member 36 of rocker lever ball 37 is connected to one end of a transition stem 38 on the other end of which a spherical member 39 is defined. Rocker lever ball socket 40 and spherical member 39 of rocker lever ball 37 are held in the illustrated assembled configuration by a rocker lever ball socket retainer 41. Rocker lever ball 37 includes a first fluid channel 42. Rocker lever ball socket 40 also includes a second fluid channel 43. At a predetermined rotation of shaft 32, rocker lever ball 37 pivots within rocker lever ball socket 40 and causing first fluid channel 42 to align with second socket fluid channel 43 thereby completing a fluid path extending between recess bore 35 of rocker lever 31 and the exterior of rocker lever ball socket 40. Second arm 34 of rocker lever 31 is adapted to engage an engine part which is not of immediate relevancy to the present invention and therefore will not be further described. It should be understood that while the retaining device of the present invention is illustrated on a rocker valve assembly for use in an internal combustion engine, other lever ball and socket systems could benefit from the design of the retaining device of the present invention.

Figure 5:
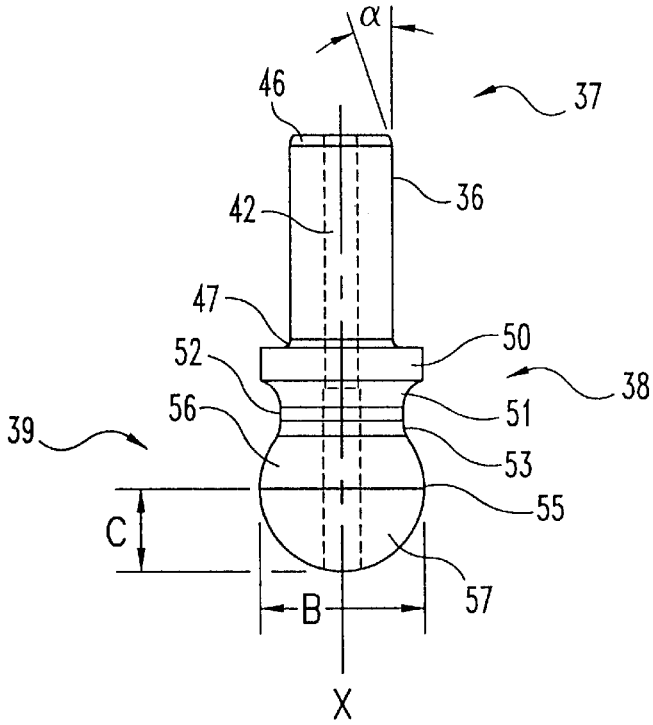
FIG. 5 is a front elevational view of a rocker ball of the rocker valve assembly of FIG. 4.

FIG. 5 shows a detailed view of an embodiment of a rocker lever ball 37 of the present invention. Rocker lever ball or valve ball or ball 37 includes a longitudinal axis X and preferably is formed by the joining of two components, a cylindrical post member 36 and a transition stem 38 having a spherical member 39 formed on one of its ends. Preferably, post member 36 is soldered to transition stem 38. However, other methods which can fixedly join post member 36 and transition stem 38, e.g., screws, may be used without deviating from the scope of the present invention. While rocker lever ball 37 is described as formed from the joining of two components, it is contemplated that rocker lever ball 37 may be formed as a single integral piece. Rocker lever ball 37 may be constructed of materials which offer dimensional stability, and can withstand the mechanical abrasion and corrosive effects of environmental agents. In the illustrated embodiment, which is designed for use in an internal combustion engine, rocker lever ball 37 is made of hardened steel. Specifically, ASTM A29/SAE J440 8620, or BS 970 805 A20 cold drawn bars.

Post member 36, configured to engage cylindrical recess bore 35 of first arm 33 of rocker lever 31, is cylindrical and includes a substantially planar upper end 46, and an opposing lower end 47. The rim of upper end 46 tapers inward at an angle $\alpha$. Preferably, angle $\alpha$ is approximately 10 degrees. Lower end 47 fixedly connects to first portion 50 of transition stem 38. In this specific embodiment, post member 36 is approximately 9.5 mm in length and 5 mm in diameter.

Transition stem 38 includes four contiguous portions 50–53, stacked concentrically along longitudinal axis X. First portion 50, which engages lower end 47 of post member 36, is cylindrical and has the largest diameter and thickness among the four contiguous wall portions 50–53. In this specific embodiment, the diameter of first portion 50 is 7.94 mm. Second portion 51 stacks below first portion 50 and is the second thickest among the four contiguous portions 50–53. Second portion 51 is concave, the circumference of which decreases continuously following a spherical profile towards third portion 52. In this specific embodiment, the radius of this spherical profile is 1.2 mm. Third portion 52 adjoins second portion 51 and is the thinnest of the four portions 50–53, and it is cylindrical. Fourth portion 53 is concave, the circumference of which increases continuously following a spherical profile towards spherical member 39. In this specific embodiment, this spherical profile has a radius of 1.2 mm.

Spherical member 39 integrally forms at the bottom of fourth portion 53 of transition stem 38. Spherical member 39 is segmented-spherical shaped, truncated at its junction with transition stem 38. An equator 55 is defined on the spherical member 39, orthogonal to longitudinal axis X, at its fullest circumference. Equator 55 has a diameter B. In this specific embodiment, diameter B is approximately 8 mm. Equator 55 divides spherical member 39 into upper and lower segments, 56 and 57, respectively. Lower segment 57 is substantially spherical and has a height C which is one-half of diameter B at equator 55. In addition, upper segment 56 and transition stem 38 has a combined height of approximately 6.36 mm. While it is shown that except for the truncated portion, spherical member 39 is substantially spherical, it is contemplated that spherical member 39 may be partially spherical having a spherical lower segment 57 and a non-spherical upper segment 56.

To provide fluid communication, a first fluid channel 42 is disposed concentrically, along longitudinal axis X, through rocker lever ball 37 and extends from post member 36, through transition stem 38, to spherical member 39. Preferably, first fluid channel 42 is formed as a single tube after post member 36 has joined with transition member 39.

Alternatively, fluid channel 42 may be formed by the joining of different pre-formed channels included in post member 36, transition stem 38 and spherical member 39. First fluid channel may be formed by conventional methods, e.g. drilling or casting, which are known to a person with ordinary skill in the art.

Figure 6:
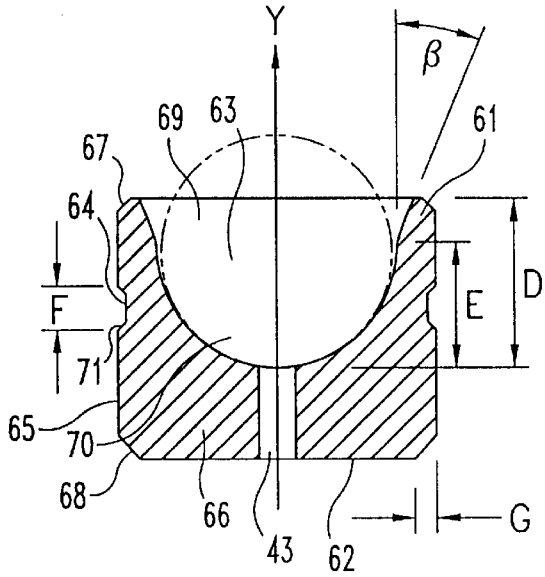
FIG. 6 is a front elevational view, in full section, of the socket of the rocker valve assembly of FIG. 4.
Figure 7:
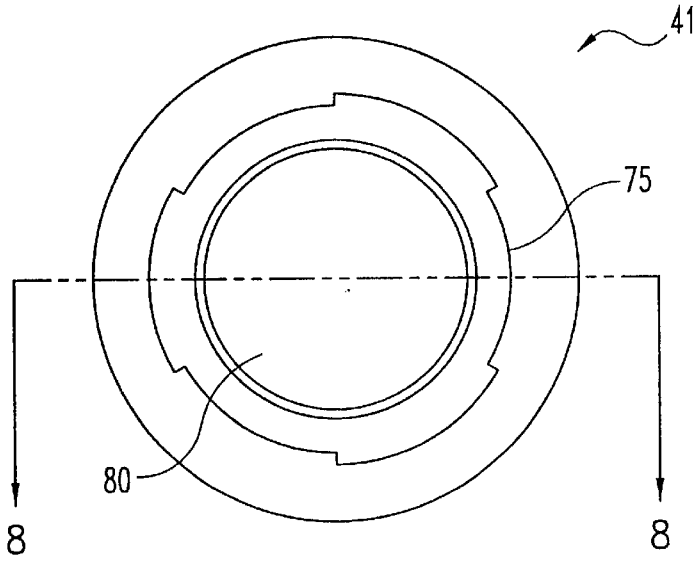
FIG. 7 is a bottom plan view of a retaining cap of the rocker valve assembly of FIG. 4.
Figure 8:
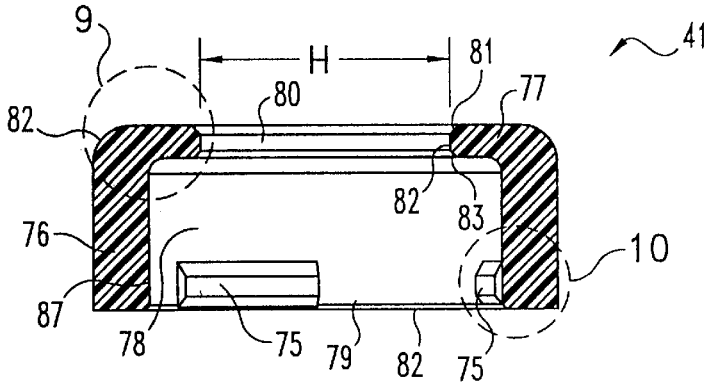
FIG. 8 is a front elevational view, in full section, of the retaining cap of the rocker valve assembly of FIG. 4 taken along line 8—8 in FIG. 7.

Referring now to FIG. 6 which shows an embodiment of rocker lever ball socket 40 of the present invention. Socket 40 is of a one-piece construction, having cylindrical exterior walls 61 and a substantially planar bottom 62, and defining a longitudinal axis Y. Socket 40 further includes an interior pocket 63, a snap groove or recess groove 64 located in the exterior surface 65 of cylindrical wall 61 and a second fluid channel 43 disposed through bottom wall 66 and connecting pocket 63 to the exterior of the socket 40. In addition, the exterior upper and lower rims 67 and 68, respectively, of socket 40 are chamfered.

Interior pocket 63 is configured to accommodate spherical member 39 of rocker lever ball 37. It has been found that a spherical surface is optimal in providing multi-axial angular variations of the position of a rocker lever ball relative to a rocker lever, interior pocket 63 is substantially spherical with the top truncated. Interior pocket 63 includes a conical entry 69 contiguous with a lower spherical section 70. Entry 69 tapers outward with a draft angle β. In this specific embodiment, draft angle β is approximately 20 degree. Lower spherical section 70 is substantially spherical, having a radius slightly larger than the radius of rocker lever ball 37. In this specific embodiment, the radius of lower spherical section 73 is approximately 4.15 mm. Furthermore, interior pocket 63, including entry 69 and lower spherical section 70, has a total depth of D, and spherical section 70 alone has a depth of E. Depth D is at least the height C of lower segment 57 of valve ball 37. Preferably, depth E of lower spherical section 70 is greater than height C ensuring that the entire lower segment 57 can be received within spherical section 70.

Recess groove 64 is provided for engagement with retaining cap 41. Recess groove 64 is located above the midline of socket 40 and extends around its entire outer circumference. The edges 71 of recess groove 69 are chamfered or rounded. Additionally, recess groove 64 has a groove width F and a groove depth G. In this illustrated embodiment, groove width F is approximately 1.4 mm. While recess groove 64 is illustrated as being positioned above the midline of socket 40, it should be understood that recess groove 64 can be positioned in other locations on the cylindrical surface 65 of socket 40. It should further be understood that while recess groove 64 has been shown to be disposed continuously around the outer circumference of socket 40, other configurations of groove 64, e.g., partially around the circumference, or multiple short sections, etc. may also be employed.

For fluid communication between interior pocket 63 and the exterior of socket 40, a second fluid channel 43 is included in the lower wall 66 of socket 40. Second fluid channel 43 extends concentrically along axis Y from the bottom of spherical section 70 of interior pocket 63 to bottom surface 62. Preferably, second fluid channel 43 has a larger cross-sectional diameter than first fluid channel 42 of rocker lever ball 37.

Similar to rocker lever ball 37, socket 40 may be constructed of hardened steel, particularly, ASTM A29/SAE J440 8620, or BS 970 805 A20 cold drawn bars. In addition, the upper portion of socket 40, including recess groove 64, is thru-hardened to enhance its fracture strength. While thru-hardening is used in this specific embodiment, other treatment process which are within the knowledge of one of ordinary skill in the art may also be used.

FIGS. 7–10 show various views of an embodiment of a rocker lever ball socket retainer or retaining cap 41 of the present invention. Retaining cap 41 is configured to assemble over socket 40. Retaining cap 41 is of a one-piece construction, has the shape of a bottle cap and includes a cylindrical wall 76 and a top 77, together, enclosing a cylindrical interior space 78 which has a large opening 79 towards the bottom. Interior space 78 is configured to receive socket 40. Top 77 includes a circular aperture 80 disposed centrally therethrough. Interior surface 87 of cylindrical wall 76 includes tabs 75 disposed thereon. In addition, exterior rim of top 77 is rounded, and the bottom of cylindrical wall 76 is substantially planar.

Aperture 80 is configured to retain rocker lever ball 37, and has a diameter H which is smaller than diameter B at equator 55 of spherical member 39 of rocker lever ball 37. Diameter H of restricted opening 80 is a critical dimension for the function of the retaining cap 41 in the rocker lever assembly 30. By changing diameter H relative to the equatorial diameter B of rocker lever ball 37, the force needed to separate the rocker lever ball socket 40 from the rocker lever ball 37 will increase or decrease. In this illustrated embodiment, for retaining rocker lever ball 37 which has an equatorial diameter B of approximately 8 mm, diameter H of aperture 80 is approximately 7.63 mm.

Figure 9:
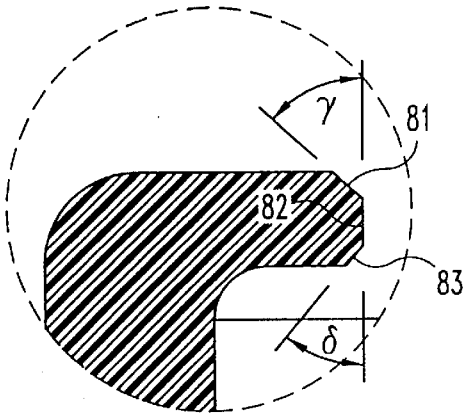
FIG. 9 is an enlarged, detailed view, in full section, of an aperture included in the retaining cap of the rocker valve assembly of FIG. 4 as indicated in area 9 of FIG. 8.

As shown in the enlarged sectional view of top 77 in FIG. 9, aperture 80 is bounded by an inner wall surface which includes three contiguous, but differently shaped, wall portions 81, 82 and 83. The upper wall portion 81 is configured for engagement with transition stem 38 of rocker lever ball 37. Upper wall section 81 is conical, tapers outwardly and upwardly at an angle γ from the junction with middle wall portion 82 towards the exterior. In this illustrated embodiment, angle γ is approximately 45 degrees.

The middle wall portion 82 is configured to retain lever ball 37. Middle wall portion 82 is cylindrical and defines the diameter of the aperture 80, which is H.

The lower wall section 83 is configured for engagement with the spherical surfaces of upper segment 56 of rocker lever ball 37. Bottom wall portion 83 is conical, tapers outwardly and downwardly at an angle δ from the junction with middle wall portion 82 towards interior space 78. While it is shown that aperture 80 is bounded by the two conical wall portions, 81 and 83, and a cylindrical wall portion 82, it is contemplated that other configurations, for example, a combination of an upper conical, a middle cylindrical and a lower spherical wall sections may be use without deviation from the scope of the invention.

Large opening 79 is configured to allow entry of socket 40 into interior space 78. Large opening 79 is bounded by the lower periphery of inner surface 87 of cylindrical wall 76. Included on the lower periphery of inner surface 87 are a bead 88 and three tabs 75. Bead 88 extends circumferentially around the entire lower periphery of inner surface 87. The tabs 75 are placed immediately above bead 88 and spaced at equal distance apart around inner surface 87. Each tab 75 occupies approximately a 55 degree arc length. Tabs 75 protrude inwardly into interior space 78.

Figure 10:
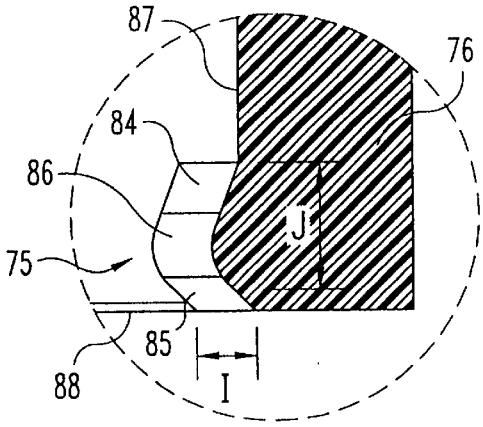
FIG. 10 is an enlarged, detailed view, in full section, of a tab defined on the retaining cap of the rocker valve assembly of FIG. 4 as indicated in area 10 of FIG. 8.

FIG. 10 shows an enlarged sectional view of an embodiment of tab 75. Tab 75 includes an upper linear rise portion 84 and lower linear rise portion 85 and a curved plateau 86 being flanked thereinbetween. In this specific embodiment, the slope of upper linear rise portion 84 is approximately 60 degrees and the slope of the lower linear rise portion 85 is approximately 45 degrees. Tab 75 has a height I and a width J. Height I is the height of curved plateau 85. Preferably, width J of tab 75 is the same thickness as groove width F of recess groove 64, and the height I is larger than depth G of recess groove 64. While tab 75 is described as having a knoll-like configuration, other configurations, such as a truncated pyramid or a truncated hemisphere, are contemplated as being within the scope of the present invention. Additionally, while three separate tabs 75 are shown, the invention contemplates that more or less than three tabs or a complete annular tab may also be used.

Retaining cap 41 may be constructed of an elastic material which is also capable of withstanding the constant mechanical pull and the environment of use. Generally, retaining cap 41 is made of thermal plastics. In one embodiment, retaining cap 41 is made of type 66 nylon plastic. Type 66 nylon plastic is chosen for its elasticity, broad temperature range and durability in used diesel engine oil. A Dupont Zytel® 103 HSL type 66 nylon plastic is found to be acceptable. Alternatively, toughened type 66 nylon plastic may be used. Toughened type 66 nylon offers the advantage that it is not susceptible to changes in atmospheric conditions. Beyond that, many characteristics of toughened type 66 nylon plastic are the same as the standard type 66 nylon plastic.

It should be noted that the process of assembling the ball and socket rocker valve assembly 30 is simple and conducive to automation. Unlike most of the prior art designs incorporating metal stampings, wire forms, and rubber o-rings which require more precise installation, the present invention involves snapping the three major components together. In one method of assembling, retaining cap 41 is first aligned over rocker lever ball socket 40 with large opening 79 of retaining cap 41 facing interior pocket 63 of socket 40. Since chamfered upper rim 67 of socket 40 presents a smaller initial diameter to retaining cap 41, a small tolerance in aligning retaining cap 41 to rocker lever ball socket 40 is allowed. A slight mis-alignment of the two parts is not critical. Once aligned, retaining cap 41 is pressed onto socket 40 through large opening 79 until tabs 75 snap into recess groove 64. The chamfering of upper rim 40 removes any sharp edges and provides a smooth engaging surface around upper rim 40. The chamfered edges 71 of recess groove 64 and the gentle rise of lower linear rise portions 85 of tabs 75 facilitate a smooth glide of tabs 75 into recess groove 64.

Because height I of curved plateau 44 is higher than depth G of recess groove 64, tabs 75 are not contained entirely within recess groove 64. Cylindrical wall 66 is torqued, resulting in a compressive force which presses tabs 75 against recess groove 64. In addition, bead 88 adds material strength against the torquing of cylindrical wall 66, thus enhancing the compressive force exerted on tabs 75. Curved plateau 44 may deform under the force and be slightly flattened, thereby increasing the contact surface between tabs 75 and recess groove 64. The increased contact surface has the effect of enlarging the frictional resistance against movement. Accordingly, once tabs 75 are locked in recess groove 64 as described above, a sufficiently large force would be required to overcome the compressive force, so that retaining cap 41 is semi-permanently fixed onto socket 40. After retaining cap 41 is secured on socket 40, a retaining cap and socket combination 90 is formed. While the illustrated configuration of tabs 75 and groove 64 enables the retention of retaining cap 41 on socket 40, it is understood and readily apparent to those skilled in the art that other tab and groove combinations or other mechanical interlocks may be used without deviating from the spirit and scope of the present invention.

Retaining cap and socket combination 90 is adapted to receive rocker lever ball 37. Preferably, rocker lever ball 37 is already secured to rocker lever 31 before it is inserted into socket 40. Rocker lever ball 37 may be securely attached to rocker lever 31 by fixedly engaging post member 36 of rocker lever ball 37 to recess bore 35 of first arm 33 of rocker lever 31. Retaining cap and socket combination 90 is placed below spherical member 39 of rocker lever ball 37, having aperture 80 aligned with the lower segment 57, and is then pushed onto lower segment 57 of spherical member 39 of rocker lever ball 37. Tapered upper wall 81 surrounding aperture 80 provides a seat for the spherical surfaces of lower segment 57 and eases the alignment effort. Aperture 80, being sized smaller than the equatorial diameter B of spherical member 39, stretches elastically to allow passage of spherical member 39 beyond equator 55 and then retracts to retain spherical member 39 within interior pocket 63. Aperture 80 allows post 36 to extend out of socket 40 and be attached to rocker lever 31. Since retaining cap and socket combination 90 is captured by the full circumference of spherical member 39 rather than only partially, a large pull-off force is required to separate rocker lever ball 12 from rocker lever ball socket 37. In this illustrated embodiment, the pull-off force has been measured at approximately 20 pounds.

In addition to increasing the pull-off force, the present invention also provides a stable support for the pivotal motion of the rocker ball. The present invention contemplates that the entire lower segment 57 of spherical member 39 of rocker lever ball 37 be captured and cradled within interior pocket 63 of socket 40, the curvature of interior surfaces of lower wall 66 mates with the exterior surfaces of spherical member 39 of rocker lever ball 37 allowing unhindered and smooth pivotal motion between the two engaging surfaces.

The valve function of rocker valve assembly 30 is accomplished by the rhythmic alignment of fluid path 42 of ball 37 with second fluid channel 43 of socket 40. With each rocking motion of rocker lever 31, ball 37 rotates and/or pivots within socket 40, causing fluid path 42 to align with second fluid channel 43, thereby temporarily allowing fluid communication between cylindrical recess bore 35 of rocker lever 31 and the exterior. Additionally, the larger cross-section of second fluid channel 43 substantially enhances the probability of aligning first fluid channel 42 and second fluid channel 43.

While first and second fluid channels 42 and 43, respectively, are illustrated as straight tubes, it will be readily apparent to those skilled in the art that channels of other shapes may be utilized as fluid paths without deviating from the spirit, scope and content of the present invention.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A method for assembling a rocker valve assembly, comprising:

providing a rocker lever valve ball having a spherical member which includes an equator defined at its fullest circumference and a first fluid passage;

providing a socket defining a pocket and a second fluid passage, wherein the pocket is sized to receive at least a portion of the spherical member;

providing a retainer having an interior space that defines an opening and an elastic aperture, wherein the aperture is dimensioned smaller than the valve ball around the equator;

securing the socket into the interior space of the retainer by inserting the socket into the opening in the retainer; and mounting the spherical member of the rocker lever ball in the socket by inserting the spherical member into the pocket through the aperture in the retainer, wherein the aperture stretches past the equator when the spherical member is inserted through the aperture and returns to a smaller size after the spherical member is received in the pocket.

2. The method of claim 1, wherein:

the socket has an exterior that defines at least one groove;

the retainer has at least one tab that extends within the interior of the retainer; and said securing includes engaging the at least one tab with the at least one groove.

* * * * *